US010716972B1

(12) United States Patent
Holtzman

(10) Patent No.: US 10,716,972 B1
(45) Date of Patent: Jul. 21, 2020

(54) OFFSET GOLF SHAFT AND COUPLING APPARATUS

(71) Applicant: Barry Lyn Holtzman, Eagle River, WI (US)

(72) Inventor: Barry Lyn Holtzman, Eagle River, WI (US)

( * ) Notice: Subject to any disclaimer, the term of this patent is extended or adjusted under 35 U.S.C. 154(b) by 0 days.

(21) Appl. No.: 16/501,287

(22) Filed: Mar. 18, 2019

(51) Int. Cl.
*A63B 53/02* (2015.01)
*A63B 53/06* (2015.01)
*A63B 53/04* (2015.01)

(52) U.S. Cl.
CPC ..... *A63B 53/02* (2013.01); *A63B 53/0466* (2013.01); *A63B 2053/021* (2013.01)

(58) Field of Classification Search
USPC ..... 473/244–248, 305–315
See application file for complete search history.

(56) References Cited

U.S. PATENT DOCUMENTS 2,027,452 A 1/1936 Rusing
2,067,556 A 1/1937 Wettlaufer
5,626,528 A * 5/1997 Toulon ..... A63B 60/00 473/248
5,653,645 A * 8/1997 Baumann ..... A63B 60/00 473/305
5,863,260 A * 1/1999 Butler, Jr. ..... A63B 60/00 473/305
5,885,170 A * 3/1999 Takeda ..... A63B 53/04 473/306
5,910,056 A * 6/1999 Nagamoto ..... A63B 60/00 473/305
5,941,781 A * 8/1999 Sessions ..... A63B 60/00 473/305
6,050,903 A * 4/2000 Lake ..... A63B 53/02 473/244
6,110,055 A * 8/2000 Wilson ..... A63B 53/00 473/239
6,547,673 B2 * 4/2003 Roark ..... A63B 53/02 473/239
6,981,922 B2 * 1/2006 Lenhof ..... A63B 53/007 473/305
7,163,463 B2 * 1/2007 Mills ..... A63B 53/02 473/244

(Continued)

FOREIGN PATENT DOCUMENTS

JP 2006042950 A * 2/2006
JP 2006042951 A * 2/2006

(Continued)

*Primary Examiner* — Alvin A Hunter

(57) ABSTRACT

In a golf club, an apparatus which provides for a shaft to be adjustably secured to a head comprises a skewed axis shaft coupling and a shaft having an intermediate shaft section which joins a nominal shaft section to an offset shaft section such that they are offset one from the other. A shaft indexing mechanism provides for the nominal shaft section to have a plurality of indexed rotational positions in a socket of the skewed axis shaft coupling, thereby providing for the head to have, with respect to the offset shaft section, a plurality of possible sets of spatial and mass distribution properties. Furthermore, the skewed axis shaft coupling provides for the head to have, with respect to the nominal shaft section, a plurality of sets of angular properties.

12 Claims, 5 Drawing Sheets

(56) References Cited

U.S. PATENT DOCUMENTS

| | | | | |
|---|---|---|---|---|
| 7,351,159 | B2 * | 4/2008 | Lai | A63B 60/54 473/305 |
| 7,621,821 | B2 * | 11/2009 | Tsai | A63B 60/00 473/306 |
| 7,704,156 | B2 | 4/2010 | Stites et al. | |
| 7,721,403 | B2 * | 5/2010 | Huang | A63B 53/02 29/458 |
| 7,722,475 | B2 | 5/2010 | Thomas et al. | |
| 7,909,706 | B2 * | 3/2011 | Cole | A63B 53/02 473/305 |
| 8,075,417 | B2 * | 12/2011 | Thomas | A63B 53/00 473/246 |
| 8,079,918 | B2 * | 12/2011 | Cole | A63B 53/02 473/305 |
| 8,142,306 | B2 * | 3/2012 | De La Cruz | A63B 53/02 473/288 |
| 8,182,357 | B2 | 5/2012 | Moore | |
| 8,246,484 | B2 | 8/2012 | Sato et al. | |
| 8,303,431 | B2 | 11/2012 | Beach et al. | |
| 8,535,173 | B2 | 9/2013 | Golden et al. | |
| 8,561,876 | B2 * | 10/2013 | Yamamoto | A63B 53/02 228/101 |
| 8,574,092 | B2 | 12/2013 | Galloway et al. | |
| 8,727,899 | B1 | 5/2014 | Galloway et al. | |
| 9,022,879 | B2 * | 5/2015 | Sato | A63B 53/02 473/307 |
| 9,033,815 | B2 | 5/2015 | Sander et al. | |
| 9,168,427 | B1 | 10/2015 | Aguinaldo et al. | |
| 9,174,097 | B1 | 11/2015 | Dacey et al. | |
| 10,220,267 | B2 | 3/2019 | Holtzman | |
| 2011/0118045 | A1 * | 5/2011 | Sato | A63B 53/02 473/307 |
| 2012/0071261 | A1 * | 3/2012 | Yamamoto | A63B 53/02 473/307 |
| 2012/0231896 | A1 * | 9/2012 | Seluga | A63B 53/02 473/314 |

FOREIGN PATENT DOCUMENTS

| | | | | |
|---|---|---|---|---|
| JP | 2007222304 | A * | 9/2007 | |
| JP | 2010131182 | A * | 6/2010 | |
| JP | 2011103985 | A * | 6/2011 | |
| JP | 2011240084 | A * | 12/2011 | |
| JP | 2012034978 | A * | 2/2012 | |
| JP | 2012165864 | A * | 9/2012 | |
| JP | 2013000178 | A * | 1/2013 | |
| JP | 2013090976 | A * | 5/2013 | |
| JP | 2013233177 | A * | 11/2013 | |
| JP | 2014113251 | A * | 6/2014 | |
| JP | 2014113253 | A * | 6/2014 | |
| JP | 2014121461 | A * | 7/2014 | |
| JP | 2018102803 | A * | 7/2018 | A63B 53/02 |

* cited by examiner

OFFSET GOLF SHAFT AND COUPLING APPARATUS

BACKGROUND

Field

This application relates to an apparatus comprising a skewed axis shaft coupling and a shaft with an offset which, in conjunction with a head, provides for any one of a plurality of possible golf club assemblies which have a plurality of possible sets of spatial, mass distribution, and angular properties of the head with respect to the shaft.

Prior Art

A golf club includes a shaft, a head, and a shaft connection mechanism which secures the shaft to the head. The head has a face for striking a golf ball, a back which is opposite the face, a bottom surface called a sole, a top surface called a crown, a heel which is its side closest to the golfer, a toe which is its side farthest from the golfer, and, located near the heel, a tubular extension called a neck. In what could be called a "simple" golf club, the shaft connection mechanism employs a direct connection in which a tip of the shaft is secured directly in a cavity, commonly called a hosel, in the neck. The hosel typically has a hosel axis, the shaft typically has a shaft axis about which it is substantially symmetric, and in the simple golf club, the shaft axis and the hosel axis are typically substantially co-linear. A golf club has three sets of properties concerning relationships between the head and the shaft which are important in this application, and they are discussed below as they apply to the simple golf club.

A first important set of golf club properties is a set of angular properties which describe various angular relationships of the head with respect to the shaft, including the golf club's loft angle, lie angle, and face angle. These angles are normally defined as being the angles the head makes with the shaft when the head is in a centered, squared, position, or CSP. For the head to be in its CSP, several conditions together must be met. With the shaft axis lying in a shaft plane which is perpendicular to a ground plane, the centered condition is met if the head's sole touches the ground plane at a point which is centered on the head's face. The squared condition is met if the head's face line, a line defined by two points on the face equally distant horizontally from the face's center and halfway up the face from the ground plane, is parallel to the shaft plane. With the head in its CSP, loft angle is the angle the head's face makes with the shaft plane, lie angle is the angle the shaft axis makes with the ground plane, and face angle is the angle the face line makes with the shaft plane which is zero if the head is in its CSP.

A second important set of properties is a set of spatial properties which includes a property called face progression. Face progression is a distance, measured perpendicularly to the head's face line, from the shaft axis to the leading edge of the head when the club is in its CSP.

A third important set of properties is a set of mass distribution properties which include a first moment of mass and a second moment of mass of the head with respect to the shaft axis. The head's first moment of mass with respect to the shaft axis is the head's mass times a torque arm length, this being a length of a line which connects the head's center of mass (COM) perpendicularly to the shaft axis. Accelerations during a golf swing and the head's first moment of mass apply torques to the shaft, thereby causing the shaft to twist about its axis. The head's second moment of mass, combined with a torsional stiffness of the shaft, determine a torsional frequency of the golf club about the shaft axis. Shaft twisting and torsional frequency are important in that they affect an "opening" and "closing" of the head's face when the club is swung.

Golf club heads have a class of properties, herein called "nominal" properties, which are defined with respect to the hosel axis. For instance, it is common for golf club heads to be stamped with a "nominal" loft. Nominal loft is a loft measured with respect to the hosel axis when placed in its CSP using the hosel axis as the shaft axis. This concept of nominal properties applies to other properties of clubs and heads, such as nominal face progression, nominal lie angle, and nominal face angle, these properties also being measured with respect to the hosel axis.

In general, there are two types of connection mechanisms currently used to secure a head to a shaft. A first type is the direct connection described above for the simple golf club wherein the shaft is secured directly in the head's hosel, usually using an epoxy bond. Direct connection does not provide for adjustment of any of the properties discussed above because the shaft is rigidly affixed to the head. In order to provide for adjustment in some golf club properties, a second type of connection mechanism has been developed which employs a shaft adapter in its connection. In shaft adapter connection, the shaft is secured to a shaft adapter and the shaft adapter is secured to the head, normally in the head's hosel.

Use of the word "hosel" can be a bit tricky in discussions which include shaft adapters. For golf clubs in which direct connection is employed, the word "hosel" is easily defined; it is a cavity in the neck into which the shaft is secured. In shaft adapter connection, definition of the word "hosel" is not obvious. When shaft adapter connection is used, a cavity in the head into which the shaft adapter is secured is herein defined as being a hosel, and a cavity located in the shaft adapter into which the shaft is secured is herein defined as being a "shaft adapter socket", or simply a "socket". The socket and the shaft's tip normally have a close-fitting relationship, the socket normally has a socket axis about which it is substantially symmetric, and therefore, when the shaft is secured in the socket, the shaft axis is normally substantially co-linear with the socket axis.

Shaft adapter connection provides several benefits. Unlike direct shaft connection which normally involves using an epoxy bond to secure the shaft in the hosel, shaft adapter connection typically uses a fastener to secure the shaft adapter in the hosel, thus providing for relatively simple shaft interchange. A second benefit is a potential ability to change the head's angular properties with respect to the shaft axis. In general, there are two types of shaft adapters, herein called "straight axis shaft adapters" and "skewed axis shaft adapters".

The straight axis shaft adapter, in typical form, includes a component herein called a straight axis fitting. The head's hosel is accepting of a lower portion of the straight axis fitting and the adapter's socket, located in an upper portion of the fitting, is accepting of the shaft. The hosel and the fitting embody indexing structures which can engage to rotationally restrain the fitting in any one of a plurality of rotational positions with respect to an axis of rotation of the fitting, herein called a component axis of rotation, or a reference axis. In most cases, the component axis of rotation is substantially co-linear with the hosel axis. In the straight axis shaft adapter, the socket axis is also substantially co-linear with the component axis of rotation. Straight axis shaft adapters provide for relatively easy shaft interchange, but they cannot adjust the head's angular properties with respect to the shaft axis due to the substantial co-linearity of the axes mentioned above.

The skewed axis shaft adapter, in typical form, includes a component which provides for its socket axis to be skewed (not parallel) with respect to the hosel axis. The shaft adapter's component and the hosel embody indexing structures which can restrain the component in a plurality of rotational positions with respect to a component axis of rotation, or reference axis, and thereby can change an angular relationship between the hosel axis and the socket axis. There are many types of skewed axis shaft adapters in use today, including types which are herein called "skewed fitting" shaft adapters and "skewed shim" shaft adapters.

The skewed fitting shaft adapter, in typical form, has a fitting, herein called a "skewed fitting", which is the adapter's component which skews the socket axis with respect to the hosel axis. The head's hosel is accepting of a lower portion of the skewed fitting and the adapter's socket, located in an upper portion of the fitting, is accepting of the shaft. The hosel and the skewed fitting's lower portion embody indexing structures which can engage to rotationally restrain the fitting in any one of a plurality of rotational positions with respect to a component axis of rotation, or again, a reference axis. As in the straight axis shaft adapter, the component axis of rotation is typically substantially co-linear with the hosel axis. The skewed fitting is constructed such that the socket axis is skewed with respect to the component axis of rotation, and therefore with respect to the hosel axis, and rotation of the skewed fitting in the hosel changes the angular relationship, and hence the angular properties, of the head with respect to the shaft. An example of a skewed fitting shaft adapter is presented in U.S. Pat. No. 8,303,431 by Beach et al.

The skewed shim shaft adapter, in typical form, comprises multiple components including a fitting, which may or may not be skewed, and one or more annularly shaped skewed shims which have, circumferentially, a non-uniform thickness. The hosel is accepting of a lower portion of the fitting, the adapter's socket is located in an upper portion of the fitting, and, in the case of an adapter with a single shim, the shim is placed between the fitting and the head's neck. The neck, the shim, and the fitting have indexing structures which engage to rotationally restrain the fitting and the shim in any one of a plurality of rotational positions with respect to a component axis of rotation, or reference axis, which again is typically substantially co-linear with the hosel axis. Rotation of the shim about the reference axis changes the angular relationship, and hence the angular properties, of the head with respect to the shaft. An example of a skewed shim shaft adapter which uses a single shim is shown in U.S. Pat. No. 8,535,173 to Golden and Harvell, and an example of one which uses two shims is shown in U.S. Pat. No. 9,174,097 to Dacey et al.

Skewed axis shaft adapters are normally limited to an adjustment range of about plus or minus two degrees, therefore typically affecting a club's nominal properties by about two degrees, plus or minus. For instance, in a driver which has a nominal loft of 9 degrees, a typical skewed axis shaft adapter which has a 2 degree "skewing" capability could cause the club to have an actual loft as low as 7 degrees or as high as 11 degrees. This loft adjustment, and other angular adjustments provided by the shaft adapter, will slightly change the torque arm length of the head's COM with respect to the shaft axis, but calculations show that this change is relatively small because the angular changes are relatively small. This means that, although useful in adjusting the club's angular properties, skewed axis shaft adapters have a minimal effect on a club's spatial and mass distribution properties. Also, these adjustments are not independent. If a skewed axis shaft adapter is positioned to provide for the head to have a particular set of angular properties with respect to the shaft, but this positioning does not produce desired sets of spatial and mass distribution properties, this is a problem.

An ability to significantly adjust a head's mass distribution properties with respect to a shaft axis is desirable and, to this end, methods have been developed to move the head's COM with respect to the hosel axis. A first method is to provide one or more weight ports in the head in which weights of different mass can be installed. A second method is to provide one or more weights which can be moved in a heel-to-toe or face-to-back direction, or both. These adjustments cause the head's COM to move internally in the head, and therefore with respect to the hosel axis.

U.S. Pat. No. 10,220,267 to Holtzman, the instant inventor, describes an apparatus which comprises a rotator which can be secured to the head in any one of a plurality of rotational positions with respect to a rotator axis of rotation. The apparatus further comprises a skewed axis shaft adapter having a component which can be secured in any one of a plurality of rotational positions with respect to a component axis of rotation, or reference axis. The reference axis is offset from the rotator axis of rotation, thereby providing for the head to have a plurality of possible sets of spatial and mass distribution properties with respect to the reference axis. In addition, the apparatus, using the skewed axis shaft adapter, provides for the head to have, with respect to the shaft, a plurality of possible sets of angular properties.

It is desirable to have an apparatus which, by using a shaft with an offset which creates a nominal shaft section and an offset shaft section, provides for a golf club to have a plurality of available sets of spatial and mass distribution properties of its head with respect to the offset shaft section, and which, by using a skewed axis shaft coupling, provides for the golf club to have a plurality of available sets of angular properties of its head with respect to the nominal shaft section.

SUMMARY

In a golf club, an apparatus which provides for a shaft to be adjustably secured to a head comprises a skewed axis shaft coupling and a shaft having an intermediate shaft section which joins a nominal shaft section to an offset shaft section such that they are offset one from the other. A shaft indexing mechanism provides for the nominal shaft section to have a plurality of indexed rotational positions in a socket of the skewed axis shaft coupling, thereby providing for the head to have, with respect to the offset shaft section, a plurality of possible sets of spatial and mass distribution properties. Furthermore, the skewed axis shaft coupling provides for the head to have, with respect to the nominal shaft section, a plurality of sets of angular properties.

DRAWINGS—FIGURES

Drawings of the present invention are as follows.

DRAWINGS—REFERENCE NUMERALS

Figure 1:
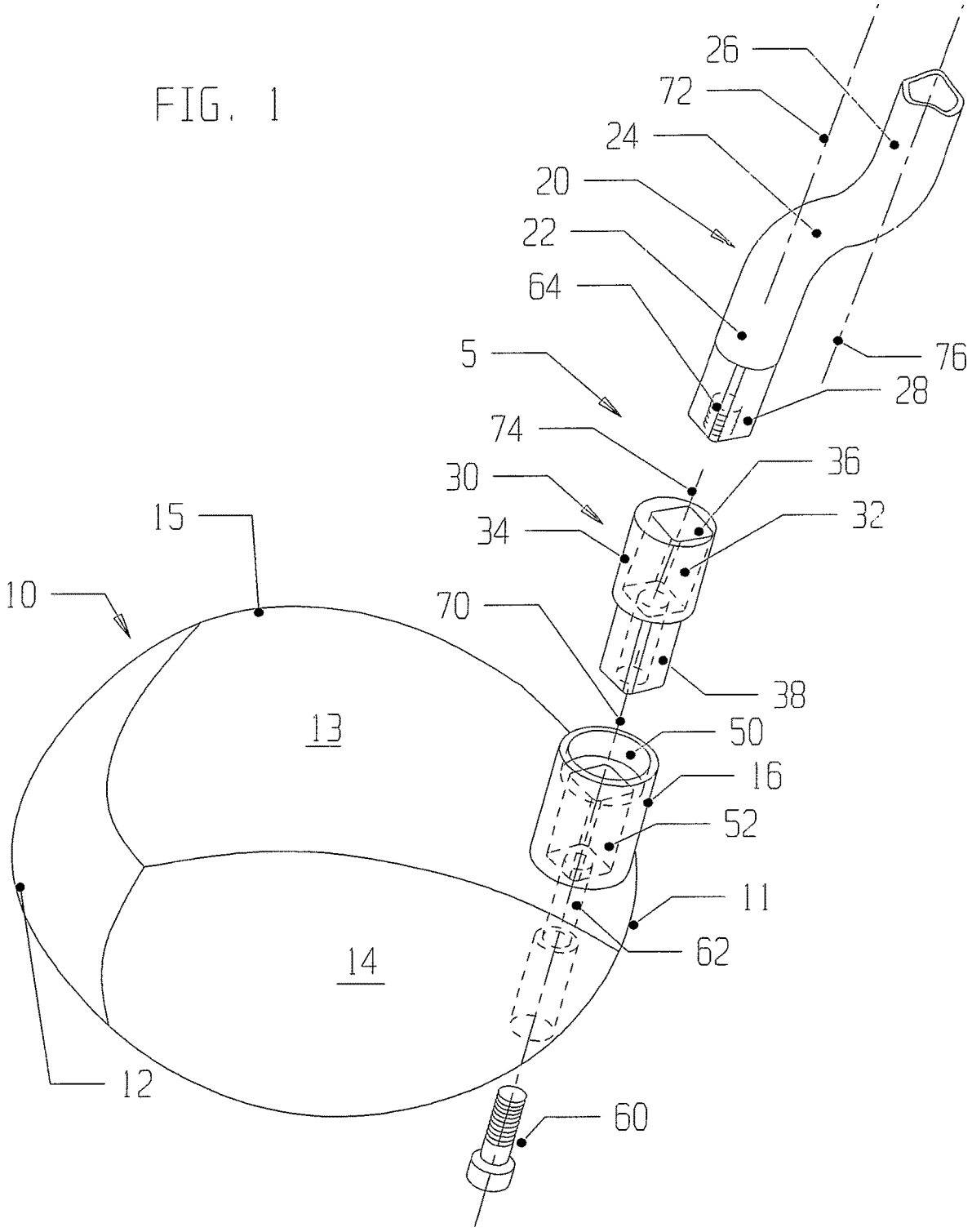
FIG. 1 is an exploded view of a first assemblage comprising a first embodiment of an apparatus of this invention.

5 offset shaft and coupling apparatus, first embodiment
10 head
11 heel
12 toe
13 crown
14 face
15 back
16 neck
20 shaft
22 nominal shaft section
24 intermediate shaft section
26 offset shaft section
28 shaft indexing structure
30 shaft coupling, first embodiment
32 socket
34 coupling fitting, first embodiment
36 socket indexing structure
38 fitting indexing structure
50 hosel
52 hosel indexing structure
60 fastener
62 hole, hosel
64 threaded hole
70 hosel axis
72 nominal shaft axis
74 socket axis
76 offset shaft axis
105 offset shaft and coupling apparatus, second embodiment
110 head, second embodiment
116 neck, second embodiment
120 shaft, second embodiment
122 nominal shaft section, second embodiment
123 bushing
124 bushing cavity
126L offset shaft section lower portion
126U offset shaft section upper portion
127 shaft cavity
128 bushing indexing structure
130 skewed shim shaft coupling
131 skewed shim
134 coupling fitting, second embodiment
138 fitting indexing structure, second embodiment
139 shim indexing structure
150 hosel, second embodiment
152 neck indexing structure

DESCRIPTION—FIG. 1—OFFSET SHAFT AND COUPLING APPARATUS, FIRST EMBODIMENT

FIG. 1, in an exploded view, shows a first assemblage which can provide any one of a plurality of possible golf club assemblies. The assemblage comprises a first embodiment of this invention, an offset shaft and coupling apparatus 5. The assemblage further comprises a head 10 which includes a heel 11, a toe 12, a crown 13, a face 14, a back 15, and a neck 16. Apparatus 5 comprises a shaft 20 which includes a nominal shaft section 22, an intermediate shaft section 24, and an offset shaft section 26. Nominal shaft section 22 embodies a shaft indexing structure 28. Apparatus 5 also comprises a shaft coupling 30 which includes a socket 32 located in a coupling fitting 34. Socket 32 embodies a socket indexing structure 36. Shaft coupling 30 includes a coupling indexing structure which, in this embodiment, is a fitting indexing structure 38 embodied in coupling fitting 34. Apparatus 5 further comprises a hosel 50, located in neck 16, which embodies a hosel indexing structure 52. Apparatus 5 further comprises a fastener 60, a hole 62 in hosel 50, and a threaded hole 64 in nominal shaft section 22. Hosel 50 is substantially symmetric with respect to a hosel axis 70, nominal shaft section 22 is substantially symmetric with respect to a nominal shaft axis 72, socket 32 is substantially symmetric with respect to a socket axis 74, and offset shaft section 26 is substantially symmetric with respect to an offset shaft axis 76.

OPERATION—FIGS. 1-5—OFFSET SHAFT AND COUPLING APPARATUS, FIRST EMBODIMENT

FIG. 1 shows how offset shaft and coupling apparatus 5 is able to provide for any one of the plurality of possible golf club assemblies. Socket 32, located in coupling fitting 34, is accepting of a portion of nominal shaft section 22, and hosel 50, located in neck 16, is accepting of a portion of coupling fitting 34. A shaft indexing mechanism comprises shaft indexing structure 28 and socket indexing structure 36 which can engage in a plurality of rotational positions of nominal shaft section 22 with respect to socket 32 in which their relative rotation is restrained. Also, a coupling indexing mechanism comprises fitting indexing structure 38 and hosel indexing structure 52 which can engage in a plurality of rotational positions of coupling fitting 34 with respect to hosel 50 in which their relative rotation is restrained. With nominal shaft section 22 in a chosen indexed rotational position in socket 32, and with coupling fitting 34 in a chosen indexed rotational position in hosel 50, fastener 60, by passing through hole 62 in hosel 50 and engaging threaded hole 64 in nominal shaft section 22, provides for coupling fitting 34 to be secured in hosel 50 and for nominal shaft section 22 to be secured in socket 32. Thereby shaft 20 is secured to head 10.

The shaft adapter connection, discussed above, typically uses a fastener to secure the shaft adapter in the head's hosel, thereby allowing the shaft adapter to be readily secured in, and removed from, the hosel. But this connection typically employs an epoxy bond to secure the shaft in the shaft adapter's socket. Similarly, fastener 60 of apparatus 5 allows for coupling fitting 34 to be readily secured in, and removed from, hosel 50, but it also allows for nominal shaft section 22 to be readily secured in, and removed from, socket 32. Because of this difference, the term "shaft coupling" is chosen herein to name the device, namely shaft coupling 30, which connects shaft 20 to hosel 50. Just as in the descriptions above for shaft adapters, if shaft coupling 30, when secured in hosel 50, skews socket axis 74 with respect to hosel axis 70, then shaft coupling 30 is herein defined as being a "skewed axis shaft coupling". Additionally, since coupling fitting 34, as shown in FIG. 1, skews socket axis 74 with respect to the component axis of rotation of shaft coupling 30 which is substantially co-linear with hosel axis 70, and since coupling fitting 34 is secured in hosel 50 directly against neck 16, shaft coupling 30 could furthermore be defined as being a "skewed fitting" shaft coupling. Therefore, similarly to skewed axis shaft adapters in prior art, shaft coupling 30 can provide for head 10 to have, with respect to nominal shaft section 22, a plurality of sets of angular properties such as loft angle, lie angle, and face angle.

Nominal properties, as discussed above, are properties which are defined with respect to the hosel axis. In that vein, the word "nominal" was chosen in naming nominal shaft section 22 with its nominal shaft axis 72. Whether shaft coupling 30 is a skewed axis shaft coupling, as shown, or a straight axis shaft coupling, the "average" position of nominal shaft axis 72, which is the component axis of rotation, or reference axis, of shaft coupling 30, would be substantially co-linear with hosel axis 70.

In addition to providing for head 10 to have a plurality of sets of angular properties with respect to nominal shaft section 22, apparatus 5 also provides for a plurality of sets of spatial and mass distribution properties of head 10 with respect to offset shaft section 26. Since offset shaft section 26 is offset from nominal shaft section 22, rotation of nominal shaft section 22 with respect to socket 32 moves offset shaft section 26 with respect to head 10. This movement changes several spatial and mass distribution properties that head 10 has with respect to offset shaft section 26, including its first and second moments of mass and its face progression.

Offset shaft and coupling apparatus 5 is therefore similar in operation to the apparatus described in the U.S. Pat. No. 10,220,267 in that both provide for a golf club head to have a plurality of sets of spatial, mass distribution, and angular properties with respect to a shaft. The apparatus in U.S. Pat. No. 10,220,267 obtains its "offset function" by securing a skewed axis shaft adapter to a rotator such that the shaft adapter's reference axis is offset from an axis of rotation of the rotator. The present invention obtains its "offset function" by using intermediate shaft section 24 to locate the offset in shaft 20 itself.

As shown in FIG. 1, the shaft indexing mechanism of apparatus 5, discussed above, provides four indexed rotationally restrained positions of nominal shaft section 22 in socket 32. FIG. 1 also shows that the coupling indexing mechanism provides four indexed rotationally restrained positions of coupling fitting 34 in hosel 50. These "four sided" indexing mechanisms were chosen by way of example, but other numbers of indexed rotationally restrained positions are possible, such as two, six, eight, or twelve.

FIGS. 2 through 5 each show nominal shaft section 22 in one of its four indexed positions in socket 32. The position of shaft 20, shown in FIG. 2, in which the torque arm length of the COM of head 10 with respect to offset shaft section 26 is large relative to the nominal torque arm length, could be called a "long torque arm" position. Another suitable name would be "high torque" position because, when shaft 20 is in this position, accelerations of head 10 during a golf swing will cause head 10 to exert a relatively high torque on offset shaft section 26. Similarly, the position of shaft 20 shown in FIG. 3 could be called a "short torque arm" position, or a "low torque" position. Its position in FIG. 4 could be called a "long face progression" position, and its position in FIG. 5 a "short face progression" position. With shaft 20 in its long torque arm position or its short torque arm position, the face progression of club 10 is substantially equal to its nominal face progression. With shaft 20 in its long face progression position or its short face progression position, the torque arm length of the COM of head 10 with respect to offset shaft axis 76 is longer than the nominal torque arm length (think hypotenuse) by a relatively small amount, but it is considerably closer to nominal than when shaft 20 is in its long or short torque arm positions.

In many cases, a construction of offset shaft and coupling apparatus 5 which includes three special conditions is beneficial. A first special condition is that shaft 20 has a construction in which offset shaft axis 76 is substantially parallel with nominal shaft axis 72. A second special condition for apparatus 5 is that its shaft indexing mechanism and its coupling indexing mechanism are constructed such that they provide for two indexed rotationally restrained positions of nominal shaft section 22 in socket 32 and coupling fitting 34 in hosel 50 wherein hosel axis 70, offset shaft axis 76, and the face line of head 10 are substantially co-planar. A third special condition, which normally is automatically met if the second special condition is met, is that these indexing mechanisms are constructed such that they also provide for two indexed rotationally restrained positions of nominal shaft section 22 in socket 32 and coupling fitting 34 in hosel 50 wherein offset shaft axis 76 and hosel axis 70 are substantially co-planar, and that plane is substantially perpendicular to the face line of head 10.

Figure 2:
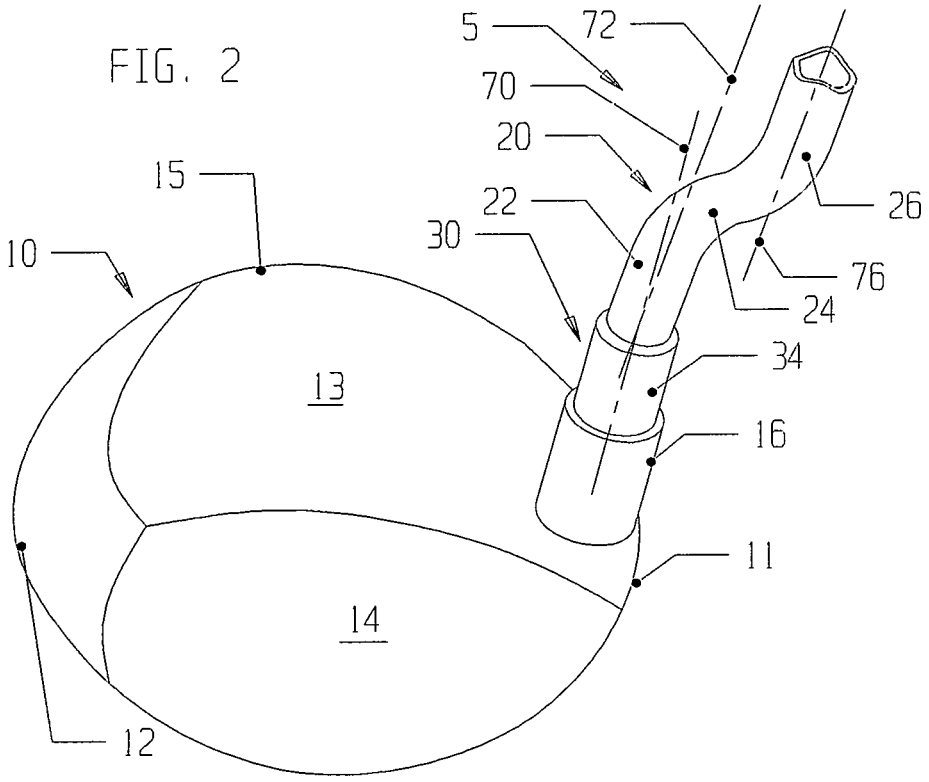
FIGS. 2, 3, 4, and 5 are views of the first assemblage assembled in four different positions.

A first benefit resulting from apparatus 5 having the special construction conditions is an independency in its adjustment ability. If apparatus 5 is so constructed, then with nominal shaft section 22 positioned in socket 32 and coupling fitting 34 positioned in hosel 50 as shown in FIG. 2, hosel axis 70, offset shaft axis 76, and the face line of head 10 are substantially co-planar. Furthermore, shaft 20 is in its long torque arm position, and head 10 has, with respect to offset shaft axis 76, a first set of spatial properties, a first set of mass distribution properties, and a set of angular properties. If nominal shaft section 22 is rotated 180 degrees in socket 32 to its short torque arm position while leaving coupling fitting 34 in its original rotational position with respect to hosel 50, these positions being shown in FIG. 3, head 10 has, with respect to offset shaft axis 76, a second set of spatial properties, a second set of mass distribution properties, but a set of angular properties which is substantially unchanged from the original set. Therefore, if apparatus 5 has a construction which includes the special conditions, apparatus 5 is able to provide for adjustments in the golf club's spatial and mass distribution properties while leaving its angular properties substantially unchanged, and vice versa.

A second benefit resulting from apparatus 5 having the special construction conditions is a maximization of its ability to affect the spatial and mass distribution properties of head 10 with respect to offset shaft section 26. If shaft 20 has the first special construction condition wherein offset shaft axis 76 is substantially parallel with nominal shaft axis 72, shaft 20 can be said to have an "offset dimension", herein defined as being a distance, measured perpendicularly, between these axes. If apparatus 5 also has the second special condition, then, for any given offset dimension of shaft 20, apparatus 5 is able to provide a maximum change in torque arm length of the COM of head 10 with respect to offset shaft axis 76 under a 180 degree rotation of nominal shaft section 22 in socket 32 from its long torque arm position to its short torque arm position. Similarly, if apparatus 5 includes the third special condition, this enables apparatus 5 to provide a maximum change in face progression of head 10 with respect to offset shaft axis 76 under a 180 degree rotation of nominal shaft section 22 in socket 32 from its long face progression position to its short face progression position.

Figure 3:
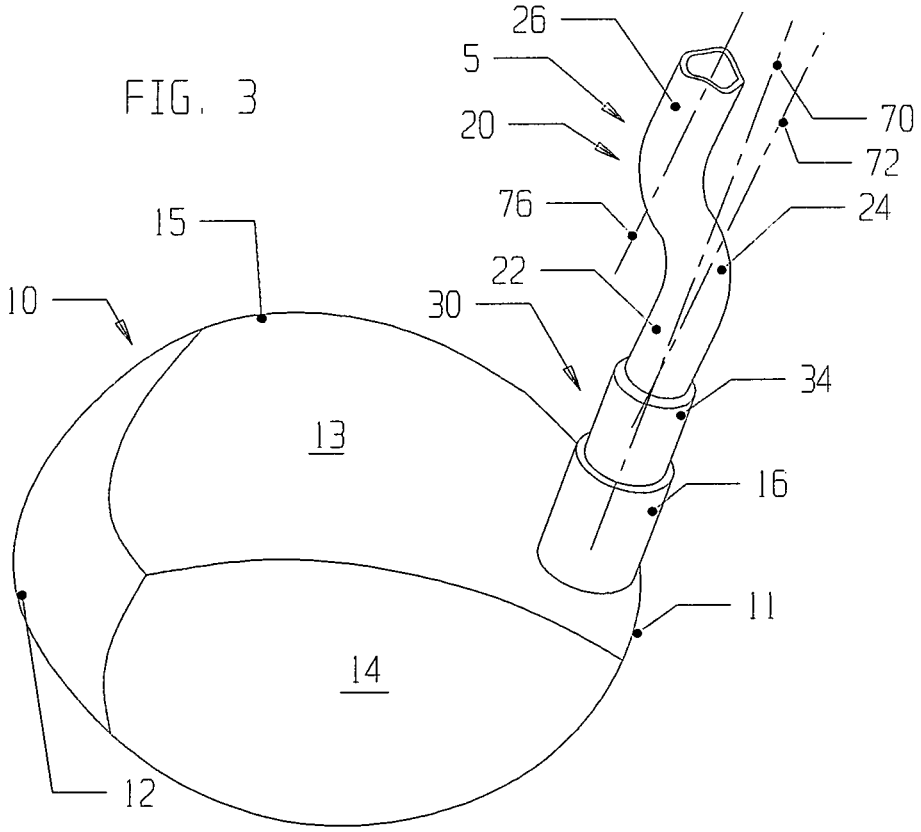
Figure 4:
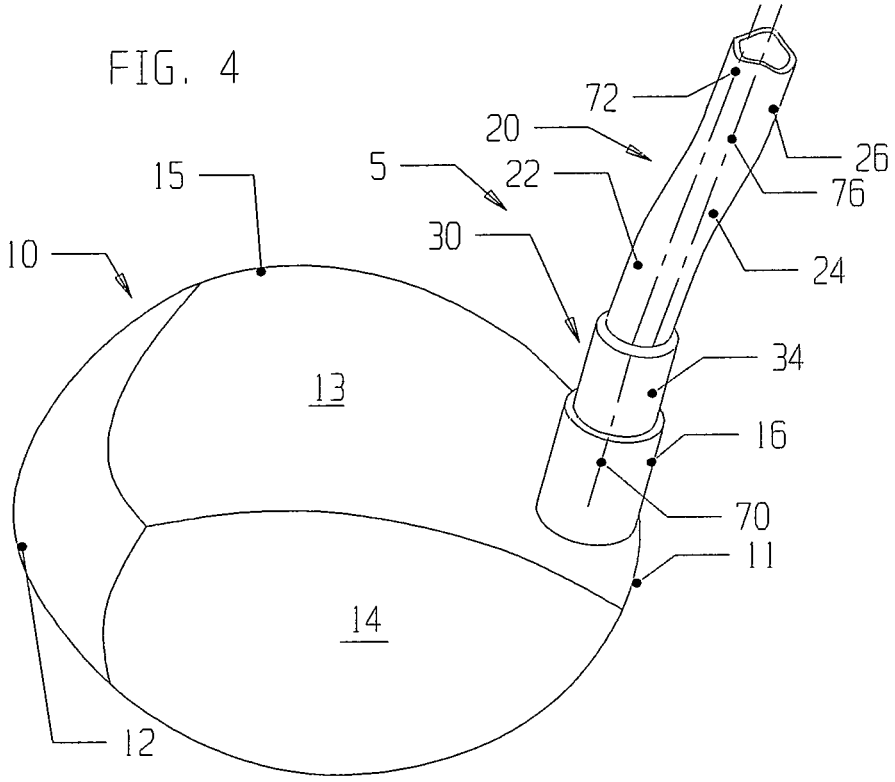
Figure 5:
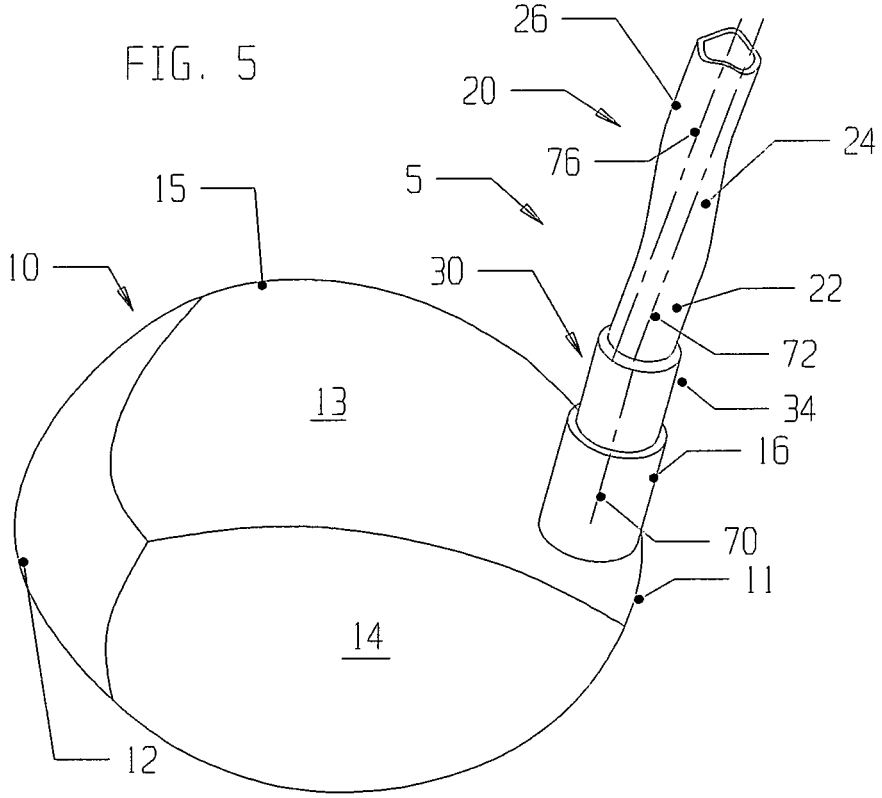

The discussions above, directed toward a simple golf club, concerning the first and second moments of mass of a golf club head with respect to a shaft are also applicable to this "more complicated" golf club which employs offset shaft and coupling apparatus 5. The first moment of mass of head 10 with respect to offset shaft axis 76 is the mass of head 10 times the torque arm length of the COM of head 10 with respect to axis 76. The mass of head 10 and accelerations in the golf swing apply torques around offset shaft axis 76 which have magnitudes determined by the accelerations and the first moment of mass of head 10 with respect to offset shaft axis 76. The COM of a typical golf club head, such as head 10, is located somewhat centered horizontally on, and slightly behind, its face, such as face 14 of head 10. Therefore, for any given golf swing, the torques applied about offset shaft axis 76 by head 10 are greater when shaft 20 is in the long torque arm length position, as shown in FIG. 2, than when it is in the short torque arm length position, as shown in FIG. 3. Torque application causes shaft 20 to twist, resulting in an "opening" or "closing" of face 14 of head 10 with respect to a target line. The second moment of mass of head 10 with respect to offset shaft axis 76 and a torsional stiffness of shaft 20 affect a torsional frequency of the opening and closing of face 14. This torsional frequency is lower when shaft 20 is in its long torque arm position, higher when in its short torque arm position, and in between when in other intermediate positions. Depending on acceleration magnitudes and their timing in a golfer's swing, his selection of the long torque arm length position, the short torque arm length position, or some intermediate position for shaft 20 can help him achieve a straight golf shot, or, if desired, one with a draw or a fade.

A USGA equipment rule states "except for putters, all of the heel portion of the club must lie within 0.625 inches (15.58 mm) of the plane containing the axis of the straight part of the shaft and the intended (horizontal) line of play". In order to comply with this rule, offset shaft axis 76 must never be farther than 15.58 mm (0.625") from heel 11, measured as described in this rule. When employed with typical golf club heads, apparatus 5 can meet this USGA rule with shaft 20 having an offset dimension of at least 7.6 mm (0.30 inches). Another USGA equipment rule states "the shaft must be straight from the top of the grip to a point not more than 5 inches (127 mm) above the sole, measured from the point where the shaft ceases to be straight along the axis of the bent part of the shaft and the neck and/or socket". Shaft 20 can be constructed such that, even with driver heads that are relatively tall and with shaft 20 having an offset dimension of 7.6 mm (0.30 inches), a golf club which employs apparatus 5 will comply with this second rule.

The word "substantially", often used in these discussions, indicates that a feature which it is modifying, such as a dimensional or angular property, has some level of "acceptable error". For instance, consider the angular relationship between nominal shaft axis 72 and offset shaft axis 76. The first special construction condition of apparatus 5 is that these axes are substantially parallel, implying that there is some acceptable, and indeed unavoidable, error in their parallelism. Even though an error of 0.25 degrees in the parallelism of nominal shaft axis 72 with respect to offset shaft axis 76 is readily attainable by those skilled in the art, an error of 0.5 degrees would probably be considered an acceptable error by many of these same people.

Figure 6:
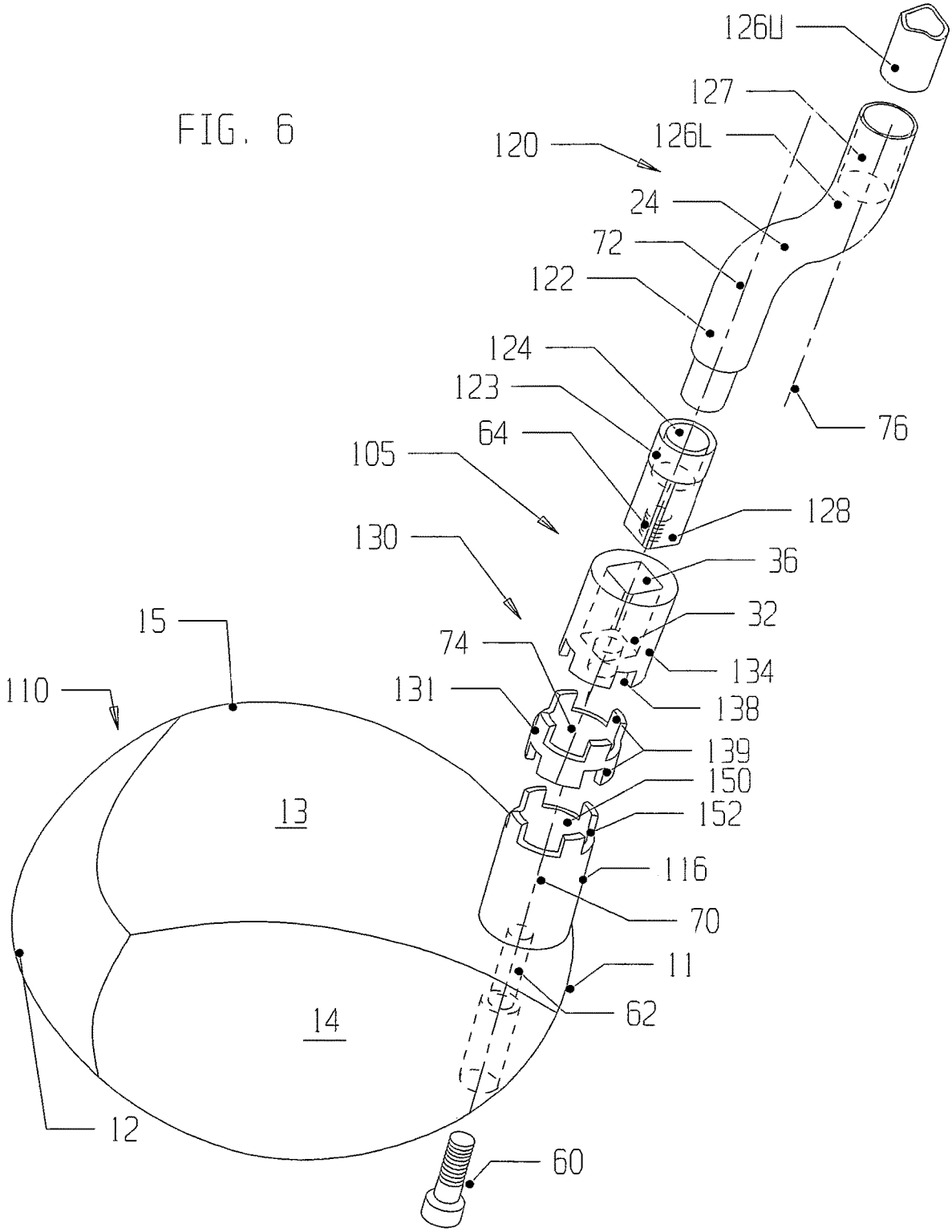
FIG. 6 shows an exploded view of a second assemblage comprising a second embodiment of the apparatus.
Figure 7:
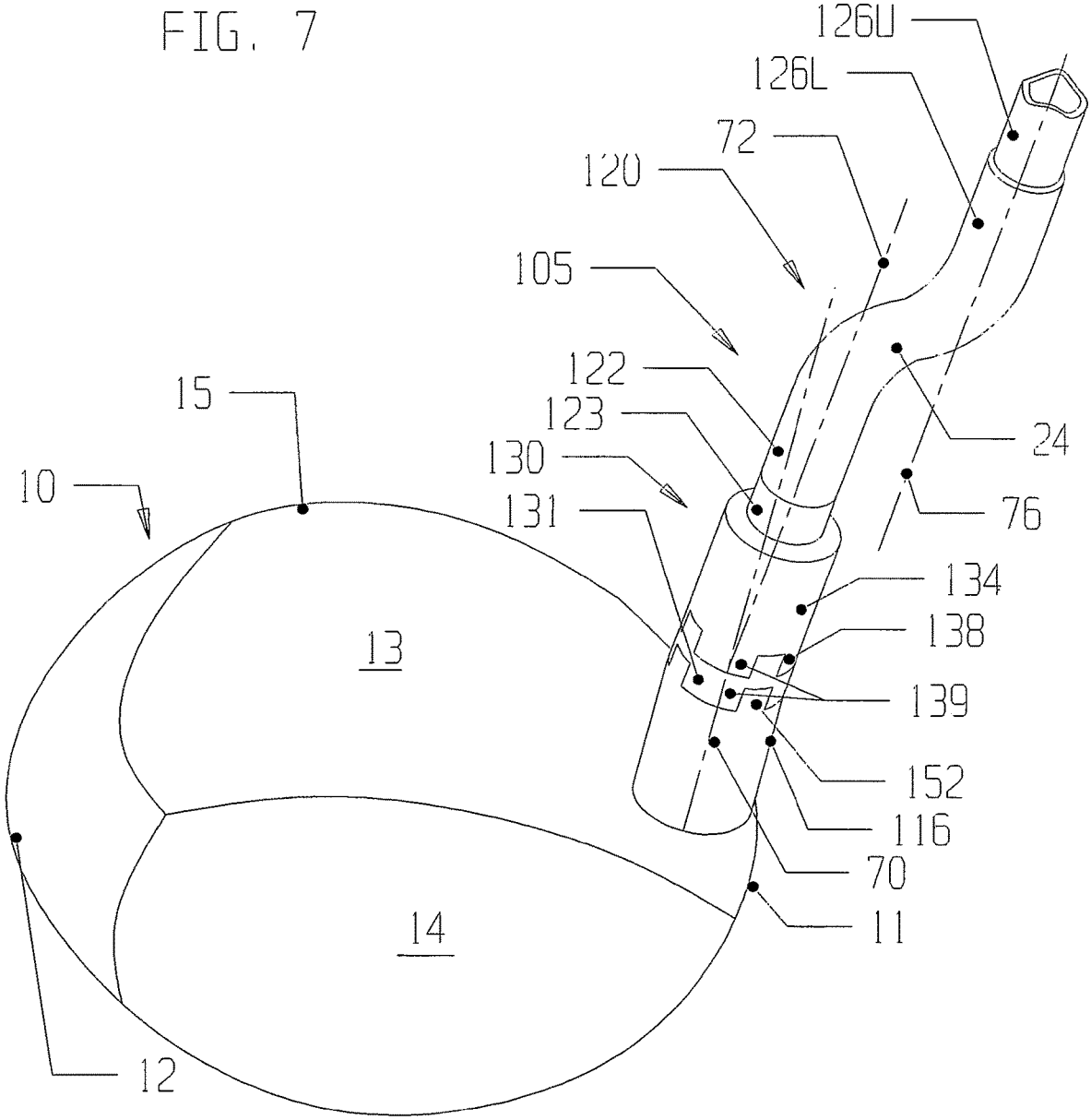
FIG. 7 is an assembled view of the second assemblage.

DESCRIPTION AND OPERATION—FIGS. 6 AND 7—OFFSET SHAFT AND COUPLING APPARATUS, SECOND EMBODIMENT

FIG. 6, in an exploded view, shows a second assemblage which can provide any one of a plurality of possible golf club assemblies. This assemblage comprises a second embodiment of this invention, an offset shaft and coupling apparatus 105. The assemblage further comprises a head 110 which is similar to head 10 except it has a neck 116 in which a hosel 150 is located, and these two features embody a neck indexing structure 152. Apparatus 105 is similar to apparatus 5 except for the following features. Apparatus 105 comprises a shaft 120 which includes a nominal shaft section 122 and a bushing 123. Bushing 123 includes threaded hole 64 and a bushing cavity 124, and it embodies a bushing indexing structure 128. Shaft 120 further includes intermediate shaft section 24, an offset shaft section lower portion 126L in which a shaft cavity 127 is located, and an offset shaft section upper portion 126U. Apparatus 105 further comprises a skewed shim shaft coupling 130 which includes two components, a skewed shim 131 and a coupling fitting 134. Skewed shim shaft coupling 130 includes a coupling indexing structure which, in this embodiment, comprises two indexing structures, a fitting indexing structure 138 embodied in coupling fitting 134 and a shim indexing structure 139 embodied in skewed shim 131.

In apparatus 5, shaft indexing structure 28 and threaded hole 64 are an integral part of nominal shaft section 22. But in apparatus 105, bushing 123 is provided and is to be secured to nominal shaft section 122 using bushing cavity 124. Threaded hole 64 is located in bushing 123, and it provides for shaft 120 to be secured to coupling fitting 134 using fastener 60. When nominal shaft section 122 is secured in bushing cavity 124, bushing indexing structure 128 provides for nominal shaft section 122 to be restrained from rotation with respect to socket 32 of coupling fitting 134 in any one of a plurality of rotational positions. Potential benefits which may accrue from using bushing 123 include ease of manufacture and improved strength of nominal shaft section 122.

In apparatus 5, shaft 20 has a one-piece construction which is particularly applicable if shaft 20 is constructed entirely of a metallic material which is readably bendable to form intermediate shaft section 24. In many golf clubs, however, it is advantageous to use a shaft which employs a carbon fiber in at least of a portion of its construction. To this end, shaft 120 of apparatus 105 incorporates a two-piece construction; a lower piece comprising nominal shaft section 122 with bushing 123, intermediate shaft section 24, and offset shaft section lower portion 126L, and an upper piece comprising offset shaft section upper portion 126U. It may be beneficial in some cases to use this two-piece shaft construction to allow, for instance, use of a metallic material to construct the lower piece and carbon fiber to construct the upper piece. Shaft cavity 127 provides for offset shaft section upper portion 126U to be secured to offset shaft section lower portion 126L by using, for instance, an epoxy bond.

Apparatus 105 employs skewed shim shaft coupling 130 which functions similarly to the skewed shim shaft adapters discussed above. Skewed shim shaft coupling 130 includes a component, skewed shim 131, which has, circumferentially, a non-uniform thickness. Shim 131 embodies, on its opposing sides, shim indexing structure 139. One side of shim indexing structure 139 is engageable with neck indexing structure 152 and the other side is engageable with fitting indexing structure 138. As in skewed shim shaft adapters, these indexing structures provide for skewed shim 131 to be rotationally restrained in any one of a plurality of possible indexed rotational positions with respect to a component axis of rotation, or reference axis, which is typically substantially co-linear with hosel axis 70. This plurality of indexed rotational positions of skewed shim 131, along with its non-uniform thickness, provides for adjustment of the angular position of head 110 with respect to nominal shaft section 122, and hence provides for head 110 to have a plurality of available sets of angular properties with respect to nominal shaft section 122 and nominal shaft axis 72.

Shaft 120 functions similarly to shaft 20 in that they both have an offset provided by intermediate shaft section 24. Bushing indexing structure 128, engageable with socket indexing structure 36, provides for nominal shaft section 122 to be rotationally restrained in any one of a plurality of possible indexed rotational positions with respect to socket axis 74. Thus, offset shaft axis 76 has a plurality of possible positions with respect to head 110, thereby providing for head 110 to have a plurality of possible sets of spatial and mass distributions properties with respect to offset shaft axis 76.

CONCLUSION, RAMIFICATIONS, AND SCOPE

Accordingly, the reader will see that herein described is an offset shaft and coupling apparatus which, along with a head, provides for any one of a plurality of possible golf club assemblies. The apparatus comprises a shaft, having an offset between a nominal shaft section and an offset shaft section, and a shaft coupling, providing for the nominal shaft section to be secured to the head in a plurality of indexed rotationally restrained positions with respect to a socket of the shaft coupling. These features provide for the plurality of golf club assemblies to have a plurality of sets of spatial and mass distribution properties of the head with respect to the offset shaft section. Embodiments presented show two types of skewed axis shaft coupling, a skewed fitting shaft coupling and a skewed shim shaft coupling, whereby the apparatus further provides for the plurality of golf club assemblies to have a plurality of sets of angular properties of the head with respect to the nominal shaft section.

Although the description above contains many specificities, these should not be construed as limiting the scope of the invention but as merely providing illustrations of it. For instance, a single fastener is shown being used to secure both the shaft to the shaft coupling and the shaft coupling to the head. But two fasteners could be used, one fastener similar to the fastener shown which secures the shaft coupling to the head, and a second fastener, being either a screw or a nut, which secures the shaft in the socket. Also, the shaft couplings shown are of the skewed axis type, but use of a straight axis shaft coupling in some cases may be desirable. Also, the two embodiments presented have some individual features, but these features, in some cases, are interchangeable. For instance the bushing of the second embodiment could be attached to the one-piece shaft of the first embodiment. Also, the skewed fitting shaft adapter of the first embodiment could be used with the two-piece shaft of the second embodiment. The scope of the invention should be determined by the appended claims and their legal equivalents rather than by the examples given.

I claim:

1. A golf club comprising:

a head;

a shaft coupling;

a shaft;

and a fastening mechanism;

wherein the head comprises a hosel with a hosel axis;

wherein the shaft coupling comprises a socket with a socket axis;

wherein the shaft comprises a nominal shaft section, an offset shaft section, and an intermediate shaft section which connects the offset shaft section to the nominal shaft section such that they are offset one from the other;

wherein the offset shaft section comprises an upper offset shaft portion and a lower offset shaft portion, and the shaft comprises a first piece comprising the nominal shaft section, the intermediate shaft section, and the lower offset shaft portion, and the shaft comprises a second piece, joined to the first piece, comprising the upper offset shaft portion, wherein the fastening mechanism secures the nominal shaft section in the socket and it secures the shaft coupling in the hosel;

wherein the shaft coupling further comprises a coupling component which, when the shaft coupling is secured in the socket, skews the socket axis with respect to the hosel axis;

wherein the nominal shaft section embodies a shaft indexing structure, the socket embodies a socket indexing structure, and there are a plurality of rotational positions of the shaft indexing structure with respect to the socket indexing structure in which these indexing structures can engage to restrain rotation of the nominal shaft section with respect to the socket, thereby providing for a plurality of available sets of spatial and mass distribution properties of the head with respect to the offset shaft section;

wherein the shaft coupling embodies a coupling indexing structure, the hosel embodies a hosel indexing structure, and there are a plurality of rotational positions of the coupling indexing structure with respect to the hosel indexing structure in which these indexing structures can engage to restrain rotation of the coupling component with respect to the hosel, thereby providing for a plurality of available sets of angular properties of the head with respect to the nominal shaft section;

whereby, with the shaft indexing structure engaged with the socket indexing structure, the golf club has one of the available sets of spatial and mass distribution properties of the head with respect to the offset shaft section, and with the coupling indexing structure engaged with the hosel indexing structure, the golf club has one of the available sets of angular properties of the head with respect to the nominal shaft section.

2. The golf club of claim 1 wherein a bushing is affixed to the nominal shaft section, the fastener secures the bushing in the socket, and the bushing comprises a bushing indexing structure which operates as the shaft indexing structure.

3. The golf club of claim 2 wherein the fastening mechanism comprises a threaded fastener which passes through a hole in the hosel and engages a threaded hole in the bushing.

4. The golf club of claim 1 wherein the first piece is constructed using a metal and the second piece is constructed using a carbon fiber.

5. The golf club of claim 1 wherein the offset shaft section has an offset shaft axis about which it is substantially symmetric, the nominal shaft section has a nominal shaft axis about which it is substantially symmetric, and the nominal shaft axis, the offset shaft axis, and the hosel axis are substantially co-planar.

6. The golf club of claim 5 wherein the head has a face line which is also substantially co-planar.

7. The golf club of claim 1 wherein the shaft coupling is a skewed fitting shaft coupling.

8. The golf club of claim 1 wherein the shaft coupling is a skewed shim shaft coupling.

9. An assemblage used to provide any one of a plurality of golf club assemblies, the assemblage comprising:

a head comprising a hosel with a hosel axis;

and an offset shaft and coupling apparatus comprising a shaft, a shaft coupling, and a fastening mechanism;

wherein the shaft coupling comprises a socket with a socket axis;

wherein the shaft comprises a nominal shaft section, an offset shaft section, and an intermediate shaft section which connects the offset shaft section to the nominal shaft section such that the offset shaft section is offset from the nominal shaft section;

wherein the fastening mechanism provides for the nominal shaft section to be secured in the socket and for the shaft coupling to be secured in the hosel;

wherein the shaft coupling further comprises a coupling component which, when the shaft coupling is secured in the hosel, skews the socket axis with respect to the hosel axis;

wherein the nominal shaft section embodies a shaft indexing structure and the socket embodies a socket indexing structure, and engagements of these indexing structures provide for the nominal shaft section to be, with respect to the socket, rotationally restrained in any of a plurality of indexed rotational positions;

and wherein the shaft coupling embodies a coupling indexing structure and the hosel embodies a hosel indexing structure, and engagements of these indexing structures provide for the shaft coupling to be, with respect to the hosel, rotationally restrained in any of a plurality of indexed rotational positions;

whereby the plurality of golf club assemblies have a plurality of sets of spatial and mass distribution properties of the head with respect to the offset shaft section and a plurality of sets of angular properties of the head with respect to the nominal shaft section.

10. A golf club comprising a head, a shaft, and a fastening mechanism:

wherein the head includes a hosel which embodies a hosel indexing structure;

wherein the shaft comprises a nominal shaft section, an offset shaft section, and an intermediate shaft section which joins the offset shaft section to the nominal shaft section such that they are offset one for the other;

wherein, when the shaft is secured to the head by the fastening mechanism, the nominal shaft section, with respect to the offset shaft section, is proximal to the head;

wherein the nominal shaft section embodies a shaft indexing structure;

wherein a shaft coupling, comprising a fitting, a socket located in the fitting, a fitting indexing structure, and a socket indexing structure, is located between the nominal shaft section and the hosel, and the fitting indexing structure, cooperating with the hosel indexing structure, restrains rotation of the fitting in one of a plurality of rotational positions of the fitting with respect to the hosel, and the socket indexing structure, cooperating with the shaft indexing structure, restrains rotation of the nominal shaft section in one of a plurality of rotational positions of the nominal shaft section with respect to the socket, whereby the nominal shaft section is restrained from rotation in one of a plurality of rotational positions with respect to the hosel and the golf club has one of a plurality of sets of spatial and mass distribution properties of the head with respect to the offset shaft section.

11. The golf club of claim 3 wherein the fitting is a skewed axis fitting, whereby the golf club has one of a plurality of sets of angular properties of the head with respect to the nominal shaft section.

12. The golf club of claim 3 wherein a skewed shim is located between the hosel and the fitting, whereby the golf club has one of a plurality of sets of angular properties of the head with respect to the nominal shaft section.

* * * * *